US005137652A

United States Patent [19]

Nakatani et al.

[11] Patent Number: 5,137,652

[45] Date of Patent: Aug. 11, 1992

[54] METHOD OF MANUFACTURING PARTICLE COLLOID OR A MAGNETIC FLUID CONTAINING METAL NITRIDES

[75] Inventors: Isao Nakatani; Masayuki Hijikata; Tsutomu Takahashi; Kiyoshi Ozawa; Takao Furubayashi; Hiroaki Hanaoka, all of Tokyo, Japan

[73] Assignee: National Research Institute For Metals, Tokyo, Japan

[21] Appl. No.: 629,555

[22] Filed: Dec. 18, 1990

[30] Foreign Application Priority Data

Dec. 18, 1989 [JP] Japan ..... 1-325909
Dec. 18, 1989 [JP] Japan ..... 1-325910

[51] Int. Cl.[5] ..... H01F 1/28
[52] U.S. Cl. ..... 252/62.51; 252/62.52
[58] Field of Search ..... 252/62.51 R, 62.52

[56] References Cited

U.S. PATENT DOCUMENTS 2,872,292 2/1959 Altmann ..... 252/62.51 R
4,025,448 5/1977 Sudol ..... 252/62.51 R

FOREIGN PATENT DOCUMENTS 2281413 12/1987 Japan .

*Primary Examiner*—Prince Willis, Jr.
*Assistant Examiner*—Thomas Steinberg
*Attorney, Agent, or Firm*—Wenderoth, Lind & Ponack

[57] ABSTRACT

A compound containing nitrogen is introduced into a solvent in which a metal carbonyl and a surface active agent are dissolved, and the solution is heated to generate a particle colloid or a magnetic fluid of a metal nitride. A particle colloid of a metal nitride with an even grain size, a good dispersibilitgy and a good fluidity, and a magnetic fluid thereof with an excellent properties are obtained with convenience and at high efficiency.

4 Claims, 2 Drawing Sheets

METHOD OF MANUFACTURING PARTICLE COLLOID OR A MAGNETIC FLUID CONTAINING METAL NITRIDES

FIELD OF THE INVENTION

The present invention relates to a method of manufacturing a particle colloid or a magnetic fluid. It relates, more particularly, to a new method for manufacturing a metal nitride particle colloid with superb dispersibility or chemically stable metal nitride magnetic fluid with high magnetization, and a metal nitride particle colloid or magnetic fluid thereby.

DESCRIPTION OF PRIOR ART

Conventionally, magnetic fluid has been attracted interest as a new functional material, and aggressive studies are being made to apply or develop it. As a particle which constitutes this magnetic fluid, an iron nitride particle is known, and as the production method therefor, the plasma CVD method that introducing $Fe(CO)_5$ vapor into glow-discharged plasma of $N_2$ gas or $NH_3$ gas has been proposed. This method is characterized by causing $N_2$ or $NH_3$ molecules excited by the plasma to react with Fe atoms generated as a result of the decomposition of $Fe(CO)_5$ molecule in the plasma, and taking the particle of iron nitride generated in the medium a containing surface active agents.

However, the reaction of conventional method mentioned above has permitted an extensive range of applications, but has requirment for the expensive reaction device and a high level of techniques, not necessarily effective either technologically or economically. There was room for improvement in magnetic characteristics and other performance of magnetic fluid.

The present invention has an object to provide a production method of particle colloid or a magnetic fluid of metal nitride which enables to manufacture the same using an easy and convenient device and means and at high efficiencies.

The present invention also has an object to provide a particle colloid or a magnetic fluid of metal nitride with superior properties manufactured by the above mentioned method.

Furthermore, the present invention has an object to provide a production device consisting of an easy-operable and convenient mechanism for manufacturing a particle colloid or a magnetic fluid of metal nitride that can be used in the aforementioned method.

These and other objects, features and advantages of the present invention will become more apparent upon a reading of the following detailed specification and drawings, in which:

DETAILED DESCRIPTION OF THE EMBODIMENT

Figure 1:
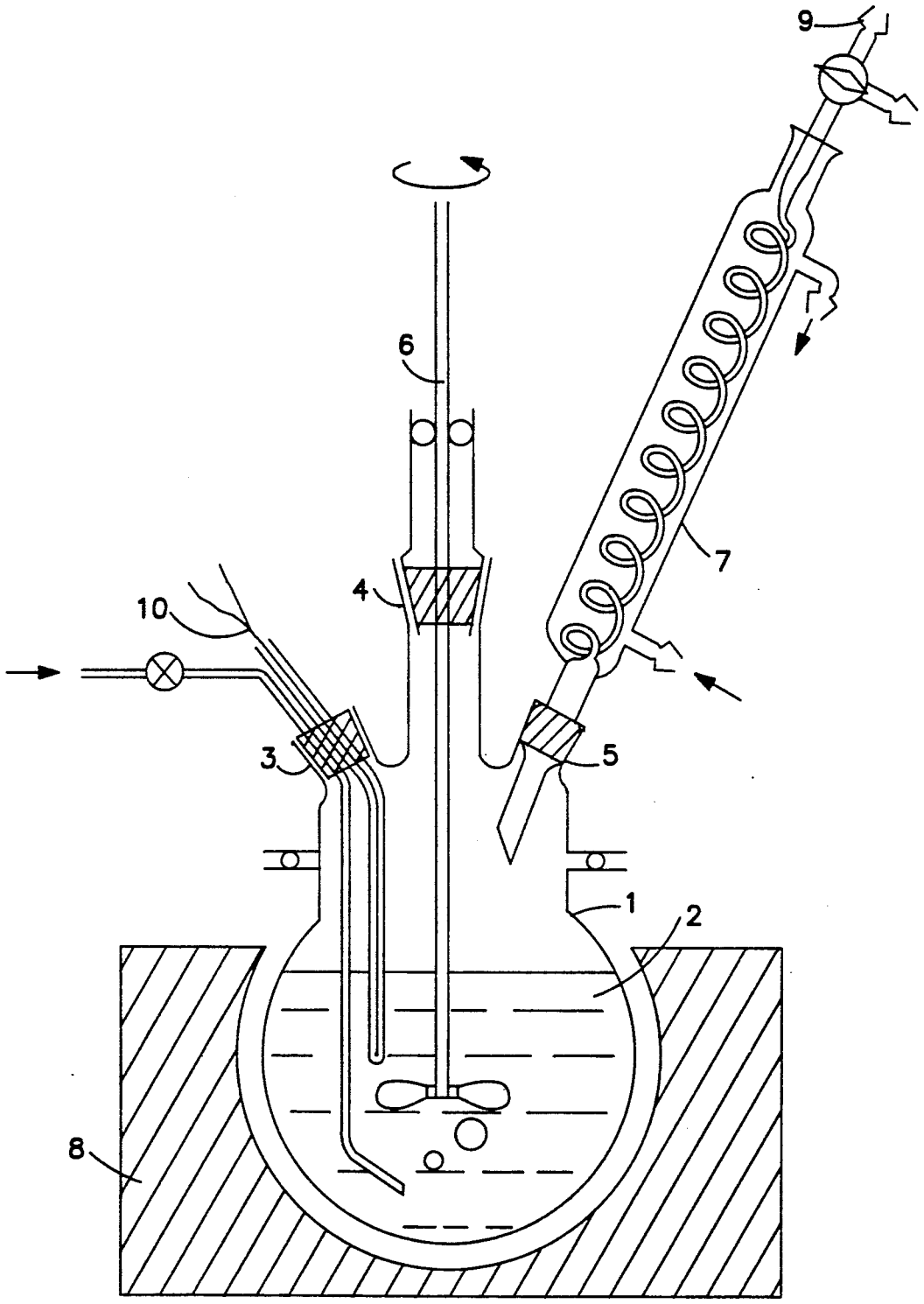
FIG. 1 is a sectional view of an embodiment of a production device that can be used in the method according to the present invention.

According to the present, a particle colloid with even grain size, a good dispersibility, a low viscosity and a fluidity, and magnetic fluid with a high magnetization can be manufactured easily and highly efficiently. It becomes also possible to manufacture a particle colloid of a metal and magnetic fluid which are stable against oxidization and are chemically stable in a humid atmosphere. Furthermore, it requires no expensive device or equipment nor high level of techniques. The raw material is less costly, the number of production processes required is smaller, and the throughput per unit hour can be increased. No hazardous wastes or exhaust gases occur, so no expenses are needed for environment preservation measures. As noted above, the present invention is economically advantageous.

A metal carbonyl to be employed in the present invention is not restricted in type, and a given metal carbonyl or a mixture of different metal carbonyls can be used. To obtain magnetic fluid, iron carbonyl is particularly useful, and cobalt carbonyl or a mixture of them is also preferred.

As a surface active agent amines, sulfonates, carboxylic acid esters, carboxylic acid salts, phosphates, phosphates, eters or other agents can be used, singularly or in combination. The most suitable among these is a surface active agent composed of amine, and which can generate, for instance, $Fe(CO)_5NH_3$, $Fe(CO)_5C_5H_5N$, $Fe(CO)_5NH_2CH_2CH_2NH_2$, and $Fe(CO)_5N_2C_{12}H_8$ As a solvent used to solve a metal carbonyl and surface active agent, non-aqueous organic solvents are preferred, and hydrocarbons, ketones, ethers, esters, amines and other appropriate solvents can be used. Among these, hydrocarbon mixtures, for instance, kerosine and light oil are advantageous from the standpoint of the dispersion stability and reactivity of the particle colloid reacted and generated. It is permissible, of course, to use these materials in combination.

As a compound containing nitrogen which is introduced into such a solvent, a highly reactive one can be used which reacts with iron carbonyl, cobalt carbonyl and other metal carbonyls to produce a metal nitride. This compound includes ammonia, an ammonia solution, and amines. They can be either gaseous, liquid or solid. For instance, when ammonia is used as a compound containing nitrogen, the ammonia gas is blown into a solvent in which a metal carbonyl and a surface active agents are solved and the solution is heated for reaction.

The heating temperature is dependent upon the construction of the reaction system, and can be selected arbitrarily by considering the reaction processes, the generation and decomposition of the intermediate, and the reaction efficiency. This heating causes a metal carbonyl and a compound containing nitrogen, or an intermediate reaction product of metal carbonyl and a compound containing nitrogen, to react and decompose, generating a particle colloid. The colloid from iron carbonyl and cobalt carbonyl, for example, becomes a magnetic fluid with high magnetizations.

Iron carbonyl $Fe(CO)_5$ and other metal carbonyl possess the property of being solved in oily matter, and $Fe(CO)_5$ and an oil soluble surface active agent are dissolved and heated up to the temperature range from 80° to 130° C. for a reaction while ammonia $NH_3$ gas is being blown. Then, $Fe(CO)_5NH_3$, an amine carbonyl compound, is generated as a precursor. When the surface active agent is an amine, $Fe(CO)_5NH_3$, $Fe(CO)_5C_5H_5N$, $Fe(CO)_5NH_2CH_2CH_2NH_2$, and $Fe(CO)_5N_2C_{12}H_8$ are generated. When heated up further to a temperature range of from 120° to 150° C., these iron-amine-carbonyl compounds are decomposed to iron nitride $FeN_x$ particles through the combination states of $Fe(CO)_3(NH_3)_2$, $Fe_2(CO)_8(C_5H_5N)_2$, $Fe_2(CO)_5(NH_2CH_2CH_2NH_2)_2$, $Fe_2(CO)_4(NH_2CH_2CH_2NH_2)_3$, $Fe(CO)_3(C_5H_5N)$, $Fe(CO)_3NH_2CH_2CH_2NH_2$, $Fe_2(CO)_{12}(NH_2CH_2CH_2NH_2)_2$. The CO gas and ammonia gas $NH_3$ generated are released out of the reaction system.

A particle of iron nitride $FeN_x$ generated in such a way is covered by a molecule of the surface active agent and disperses directly into the solvent, becoming a colloid of iron nitride particle. This colloid becomes a magnetic fluid with a high saturation magnetic flux density, with a highly excellent dispersion stability, and with a high stability against oxidation in a humid atmosphere.

Such a particle colloid or magnetic fluid can be manufactured by the device shown in FIG. 1.

This device has a cover of a heat resistant reaction chamber (1) which is disassembled into a body and a cover. The cover has three induction ports (3), (4) and (5). Through the tube attached to the induction port (3), ammonia gas $NH_3$ is introduced. Through the introduction port (4), a rotary shaft (6) is inserted to stir a solution in the direction of the arrow. At the introduction port (5) a cooler (7) is provided through which cooling water is passed. In addition, a resistor heating unit (8), for example, a heater is used to heat the reaction chamber (1), and the gas, primarily CO gas, generated as a result of a reaction is discharged out of the reaction system through an exhaust port (9) of the cooler (7). The numeral (10) indicates a thermocouple, a resistance thermometer or other temperature sensor.

Evaporated $Fe(CO)_5$ and kerosine from the solution (2) are condensed by the cooler (7), return to the solution and circulate through the reaction system.

An example will be shown below in which a device with the above construction is used to manufacture a magnetic fluid of iron nitride.

EXAMPLE 1

The 6 mass % kerosine solution of surface-active agent 75 g and iron carbonyl 120 g were put into a reaction chamber (1) with a capacity of 500 cc and ammonia gas $NH_3$ was introduced at a flow rate of 300 cc/min through the introduction port (3). Then, the solution (2) was stirred with a poker on the tip of the rotary shaft (6). The reaction chamber (1) was heated up to the temperature range from 120° to 150° C. with a resistance heater (8). The $Fe(CO)_5$ and kerosine evaporated from the solution (2) were condensed with the cooler (7), returning to the solution and circulating through the system. During the process, $Fe(CO)_5$ reacts with ammonia $NH_3$, and generated iron-nitrides particles in the solution (2). The gas generated by the reaction was exhausted out of the reaction system from the exhaust port (9) of the cooler (7).

The reaction ended by heating for approx. 100 minutes. Iron nitride magnetic fluid of 100 cc was obtained in the reaction chamber (1). The iron-nitride magnetic fluid thus obtained proved to have a saturation magnetic flux density of 750 gausses. It was excellent in dispersion stability, difficult to oxidize in a humid atmosphere and chemically stable.

After the reaction was completed, while the equivalent amount of iron carbonyl $Fe(CO)_5$ and a surface active agent were being added, two cycles of the reaction processes were operated repetitively under the same conditions. This could increases the density of the iron nitride particles in the solvent without impairing the dispersion stability and other performances. As a result, 110 cc magnetic fluid of iron nitride with 1400 gausses saturation magnetic flux density was obtained.

EXAMPLE 2

Under the same conditions, except using cobalt carbonyl $Co_2(CO)_8$ as raw material, 120 cc cobalt nitride magnetic fluid was obtained. This cobalt nitride magnetic fluid had a saturation magnetic flux density of 1300 gausses, offering superb dispersion stability, is difficult to oxidize in a humid atmosphere and is chemically stable.

Incidentally, when a particle colloid or a magnetic fluid is to be produced with the device as shown in FIG. 1, it is required to add an iron carbonyl $Fe(CO)_5$ or other materials and a surface active agent to react a multiple number of times, and cool the device to room temperature for each addition. To enrich the magnetic fluid obtained, one must take the trouble to shift the reaction product to a rotary evaporation device and other vacuum heating evaporating device.

Figure 2:
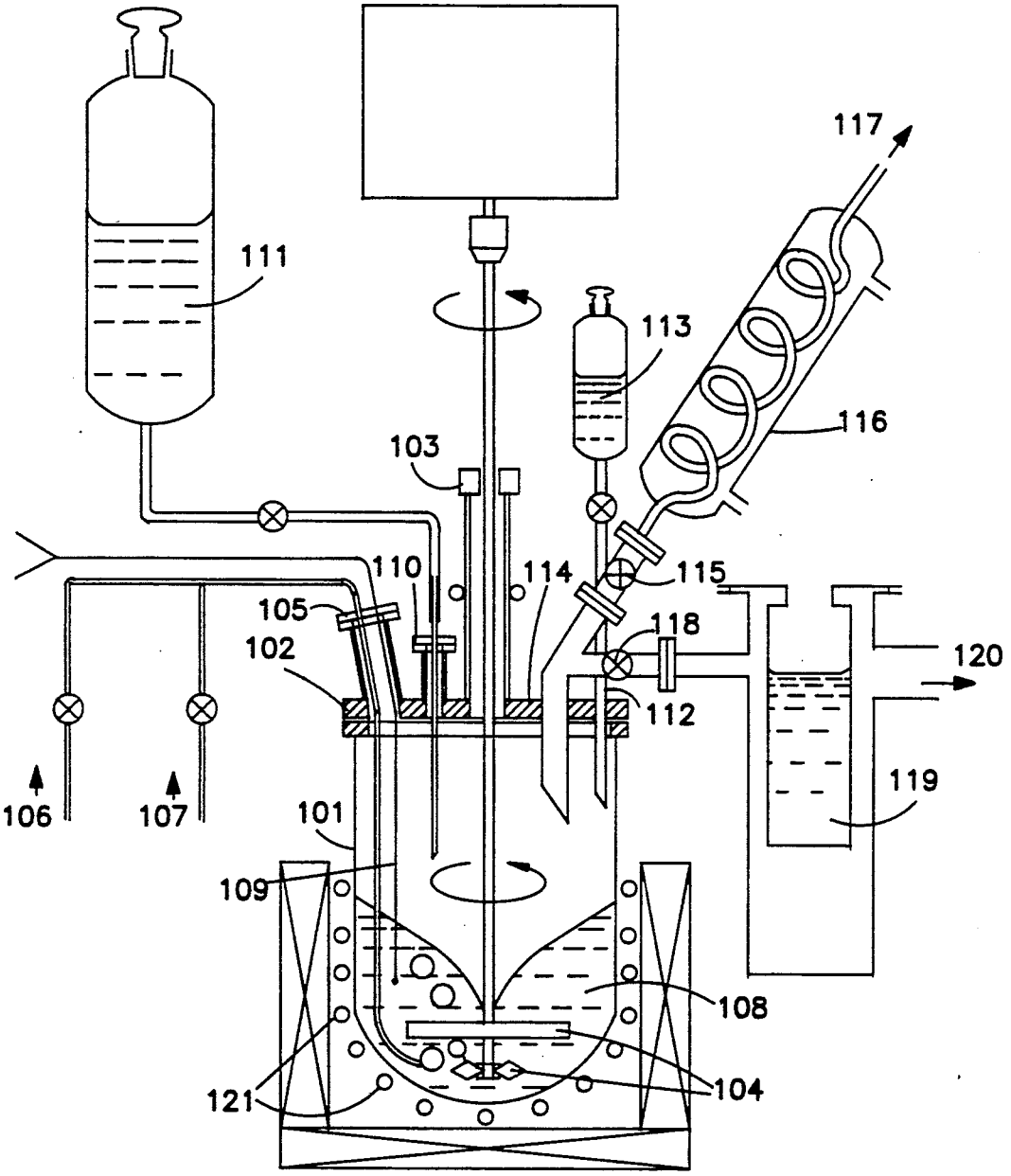
FIG. 2 is a sectional view of an embodiment of a production device according to the present invention.

To solve this problem, the present invention provides a device as shown in FIG. 2. The present invention can eliminate such a tronble and manufacture a magnetic fluid improved highly. A particle collid is, of course, obtained by the device. As shown in FIG. 2, a cover (102) having several air-tight introduction flanges (103) (105) (110) is connected air-tightly to a reaction chamber (101) with a round bottom of heat-resistant material or preferably metal. Into the introduction flange (103), a rotary shaft is inserted, and a porker (104) is provided at the tip of the rotary shaft to stir the solution (108). Through the introduction tube (106), ammonia gas $NH_3$ is introduced as a compound containing nitrogen, and an inert gas was introduced into the solution (108) through the introduction tube (107). To control the reaction temperature, a thermocouple, a resistance thermometer or a temperature measurement means (109) is inserted into a reaction chamber (101) through the introduction flange (105). As the introduction flange (110), a tube path is provided to introduce a metal carbonyl (111), and an introduction port (112) is designed to introduce a surface active agent (113).

In this example a tube path provided at an introduction port (114) is subdivided into two branches. A circulation cooling unit (116) is connected to one of the branches through a valve (115). An exhaust gas is discharged out of the outlet (117) of this cooling unit (116), and a contaminated gas is collected through an appropriate trap for subsequent discharge to the atmosphere. On the other branch, a capacitor (119) as a distillation cooling unit cooled by a liquified nitrogen trap or a freezer is connected. The outlet of this capacitor (119) is linked to a vacuum exhaust device.

The bottom of the reaction chamber (101) is constructed so that it is heated with a heater and other heating device (121).

In this device, to cause the porker (104) to rotate, instead of a rotatry shaft and the introduction flange (103), a magnetic binding rotary driving unit can be used. It is possible to eliminate the surface active agent vessel (113) by putting the surface active agent (113) in the container for the metal carbonyl (111).

An example where an iron nitride magnetic particle is manufactured with this device will be given below.

EXAMPLE 3

N-tetraetylene pentamine polybutenyl succinimido (17 g) as a surface active agent (113) was added into kerosine (190 g) contained in a stainless steel reaction chamber (101) with capacity of 500 cc. iron carbonyl $Fe(CO)_5$ of 144 g was introduced as a metal carbonyl, and ammonia gas $NH_3$ was introduced into the solution at a flow rate of 300 cc/min through an introduction tube (106) while the solution was being stirred.

On the other hand, the valve (118) was closed and valve (115) was opened, heating a solution (108) to 125° C. with a heating device (121). The iron carbonyl $Fe(CO)_5$ and the solvent, kerosine, evaporated from the solution, was condensed in the circulating cooling device (116) to cause it return to the solution (108), and circulate it through the system. During the process, the iron carbonyl $Fe(CO)_5$ reacted with ammonia gas $NH_3$ to produce an iron nitride particle in the solution (108). The gas, primarily CO gas, generated as a result of this reaction was discharged out of the reaction system through the exhaust port (117) of the circulating cooling device (116).

Approx. 100 minutes later, the reaction was completed, but the surface active agent (113) and the metal carbonyl (111) were added in equivalent quantity in the same manner, for a total of three experiments. About 180 cc iron nitride particle colloid was obtained.

Then, the solution (108) was cooled to 100° C., the valve (118) was opened with the other valve closed, reducing the pressure of the reaction system with an oil rotary vacuum pump through the outlet (120) and evaporating the high vapor pressure portion in the solvent and unreacted $Fe(CO)_5$. This evaporated substance was condensed in a capacitor (119) as a distillation cooling device, and an iron nitride solution (108) was condensed to convert it to a colloid with low vapor pressure.

By the above reaction, 120 cc iron nitride magnetic fluid with a saturation magnetic flux density of 1700 gausses was obtained. This magnetic fluid has a low vapor pressure, and was not changed according to the evaporation of the solvent, although left in the atmosphere and under vaccum for a long time.

EXAMPLE 4

Under the same conditions, except using 60 g cobalt carbonyl $Co_2(CO)_8$ as a raw material, 120 cc cobalt nitride magnetic fluid was obtained. This cobalt nitride magnetic fluid had a saturation magnetic flux density of 1300 gausses, offering superb dispersion stability, and which is difficult to oxidize in a humid atmosphere and is chemically stable.

With this production device, it has become easier to control the density of the metal nitride particles in the magnetic fluid, and the generation and condensation of a metal nitride particle colloids can be performed continuously in the same container, resulting in a remarkably improved operation efficiency. This generation and condensation of a metal nitride particle colloid can be performed without any contact with atmospheric air so that reduction of the properties of a substance generated in a production process can be prevented. Economical advantages can also be obtained.

Needless to say, the present invention is not limited by the foregoing examples. Various configurations in the detail thereof are possible.

We claim:

1. A method of manufacturing a particle colloid or a magnetic fluid of a metal nitride wherein ammonia, an ammonia solution or an amine compound is introduced into a solvent in which a metal carbonyl and a surface active agent are dissolved and the solution is heated at temperatures sufficient to react the metal carbonyl with ammonia, an ammonia solution or an amine to produce the particle colloid or magnetic fluid containing the metal nitride.

2. A method of manufacturing a particle colloid or a magnetic fluid of a metal nitride as claimed in claim 1, wherein the surface active agent is an amine.

3. A method according to claim 1 in which the reaction is carried out in a covered reaction chamber and the reaction solution stirred during the reaction and wherein the reaction chamber is provided with cooled distillation unit connected to a port in the reaction chamber whereby the various reactants and solvent components, evaporated during the reaction, are condensed and returned to the reaction chamber.

4. A method according to claim 3 wherein the reaction chamber is provided with various ports for introducing the materials employed in the reaction.

* * * * *